US005358415A

United States Patent [19]

Nitta et al.

[11] Patent Number: 5,358,415

[45] Date of Patent: Oct. 25, 1994

[54] SPARK PLUG CAP

[75] Inventors: Shigemitsu Nitta, Kakogawa; Mikio Kamitake, Kobe, both of Japan

[73] Assignee: Kawasaki Jukogyo Kabushiki Kaisha, Kobe, Japan

[21] Appl. No.: 150,863

[22] Filed: Nov. 12, 1993

Related U.S. Application Data

[62] Division of Ser. No. 5,215, Jan. 15, 1993, Pat. No. 5,297,971.

[30] Foreign Application Priority Data

Jul. 17, 1992 [JP] Japan ..... 4-213305

[51] Int. Cl.[5] ..... H01R 11/28

[52] U.S. Cl. ..... 439/125

[58] Field of Search ..... 439/125-128, 439/205, 206

[56] References Cited

U.S. PATENT DOCUMENTS 2,866,957 12/1958 Raypholtz ..... 439/606

FOREIGN PATENT DOCUMENTS 2112187 4/1990 Japan .

3254088 11/1991 Japan .

*Primary Examiner*—Gary F. Paumen

*Attorney, Agent, or Firm*—Leydig, Voit & Mayer

[57] ABSTRACT

A spark plug cap includes a metal connection member for electrically connecting a spark plug to a high-voltage cord and a tubular rubber body fitted on an end of the high-voltage cord and on an insulating portion of the spark plug to seal the end and the insulating portion. A core member is mounted within the rubber body surrounding the metal connection member, and the core member has a through hole. The through hole places a space, formed between the spark plug and the rubber body, in communication with a contact surface between the core member and the rubber body. Even if the rigidity of the rubber body is increased, this construction eliminates the possibility that the plug cap will be lifted or displaced relative to the spark plug by air compressed within the plug cap when the plug cap is attached to the spark plug.

6 Claims, 3 Drawing Sheets

SPARK PLUG CAP

This disclosure is a division of application Ser. No. 08/005,215, filed Jan. 15, 1993, now U.S. Pat. No. 5,297,971 issued Mar. 29, 1994.

BACKGROUND OF THE INVENTION

This invention relates to a spark plug cap adapted to be attached to a spark plug of an engine.

A motorcycle and a boat are subjected to large vibrations, and are exposed to fresh water or seawater, and therefore a spark plug cap having a core member mounted within a rubber body is used in these vehicles (see, for example, Japanese Patent Unexamined Publication Nos. 2-112187 and 3-254088). One example of such a spark plug cap is shown in FIG. 3.

In FIG. 3, a plug cap 102 having a perpendicularly-bent, tubular rubber body 120 is attached to an insulating portion 111 of a spark plug 101. A metal connection member 121 for contact with a plug terminal 112 of the spark plug 101 is mounted within the plug cap 102. The metal connection member 121 is connected to a high-voltage cord 103 (indicated in phantom) via a bar-like resistor 122 and a screw 123, thereby electrically connecting the spark plug 101 to the high-voltage cord 103.

The rubber body 120 includes a cap body 124, and a terminal body 125 formed integrally with the cap body 124. The cap body 124 is attached to the insulating portion 111 of the spark plug 101 to seal the outer periphery of the insulating portion 111. An end portion of the high-voltage cord 103 is attached to a distal end portion 125*a* of the terminal body 125, so that the outer periphery of the end portion of the high-voltage cord 103 is sealed by the distal end portion 125*a*. The outer peripheries of the insulating portion 111 and the high-voltage cord 103 are thus sealed, thereby preventing fresh water or seawater from intruding along the outer peripheral surfaces of the insulating portion 111 and the high-voltage cord 103.

A core member 126 made of a plastic material is mounted within the rubber body 120. The core member 126 surrounds the metal connection member 121 and the bar-like resistor 122. The core member 126 extends downwardly beyond the plug terminal 112 into the peripheral wall of the cap body 124, thereby increasing the rigidity of the cap body 124. With this construction, the plug cap 102 can be firmly connected to the spark plug 101, so that the shaking of the plug cap 102 due to vibrations can be prevented, and therefore the plug terminal 112, the metal connection member 121 and the high-voltage cord 103 are enhanced in durability.

As described above, the insulating portion 111 is held in sealing contact with the rubber body 120, and when the rigidity of the cap body 124 is increased as described above, the compressive force of the rubber disposed inwardly of the core member 126 increases to enhance the above sealing effect. Therefore, when the plug cap 102 is attached to the spark plug 101, the air within the plug cap 102 cannot easily escape, so that the air is compressed and is sealed in a space S between the spark plug 101 and the rubber body 120. Therefore, at the time of attachment of the plug cap 102 or during the operation of the engine, the plug cap 102 may be lifted or displaced, which results in a possibility that the connection metal member 121 fails to be held in proper contact with the plug terminal 112.

SUMMARY OF THE INVENTION

With the above problem in view, it is an object of this invention to provide a spark plug cap which will not be lifted or displaced relative to a spark plug even if a rubber body of the plug cap is increased in rigidity.

According to one aspect of the present invention, there is provided a spark plug cap comprising:

a metal connection member for electrically connecting a spark plug to a high-voltage cord;

a tubular rubber body for mounting on an end of said high-voltage cord and an insulating portion of the spark plug to seal the end and the insulating portion; and a core member mounted within said rubber body surrounding said metal connection member, said core member having a through hole formed therein, whereby said through hole places a space, between the spark plug and said rubber body in communication with a contact surface between said core member and said rubber body.

In this construction, the space within the plug cap is in communication with the surface or area of contact between the core member and the rubber body, and therefore when the pressure within this space increases, the rubber body is expanded by this pressure, so that the air within the above space intrudes into the contract surface between the core member and the rubber body. This contact surface is extended over the entire outer peripheral surface of the core member, and hence has a large surface area, and therefore the intrusion of the air into the contact surface restrains the increase of the pressure within the above space.

According to another aspect of the invention, there is provided a spark plug cap comprising:

a metal connection member for electrically connecting a spark plug to a high-voltage cord;

a tubular rubber body for mounting on an end of said high-voltage cord and an insulating portion of the spark plug to seal the end and the insulating portion; and a core member mounted within said rubber body surrounding said metal connection member, said core member having a recess communicating with a space between the spark plug and said rubber body.

According to further aspect of the invention, there is provided a spark plug cap comprising:

a metal connection member for electrically connecting a spark plug to a high-voltage cord:

a tubular rubber body for mounting on an end of the high-voltage cord and an insulating portion of the spark plug to seal the end and the insulating portion;

a core member mounted within the rubber body surrounding the metal connection member;

a recess extending from an inner surface of the core member, through the core member, into the tubular rubber body, the recess communicating with a space between the spark plug and the rubber body; and a support cap in the tubular rubber body and defining an end surface of the recess.

DESCRIPTION OF THE PREFERRED EMBODIMENTS

A preferred embodiment of the present invention will now be described with reference to FIG. 1.

Figure 1:
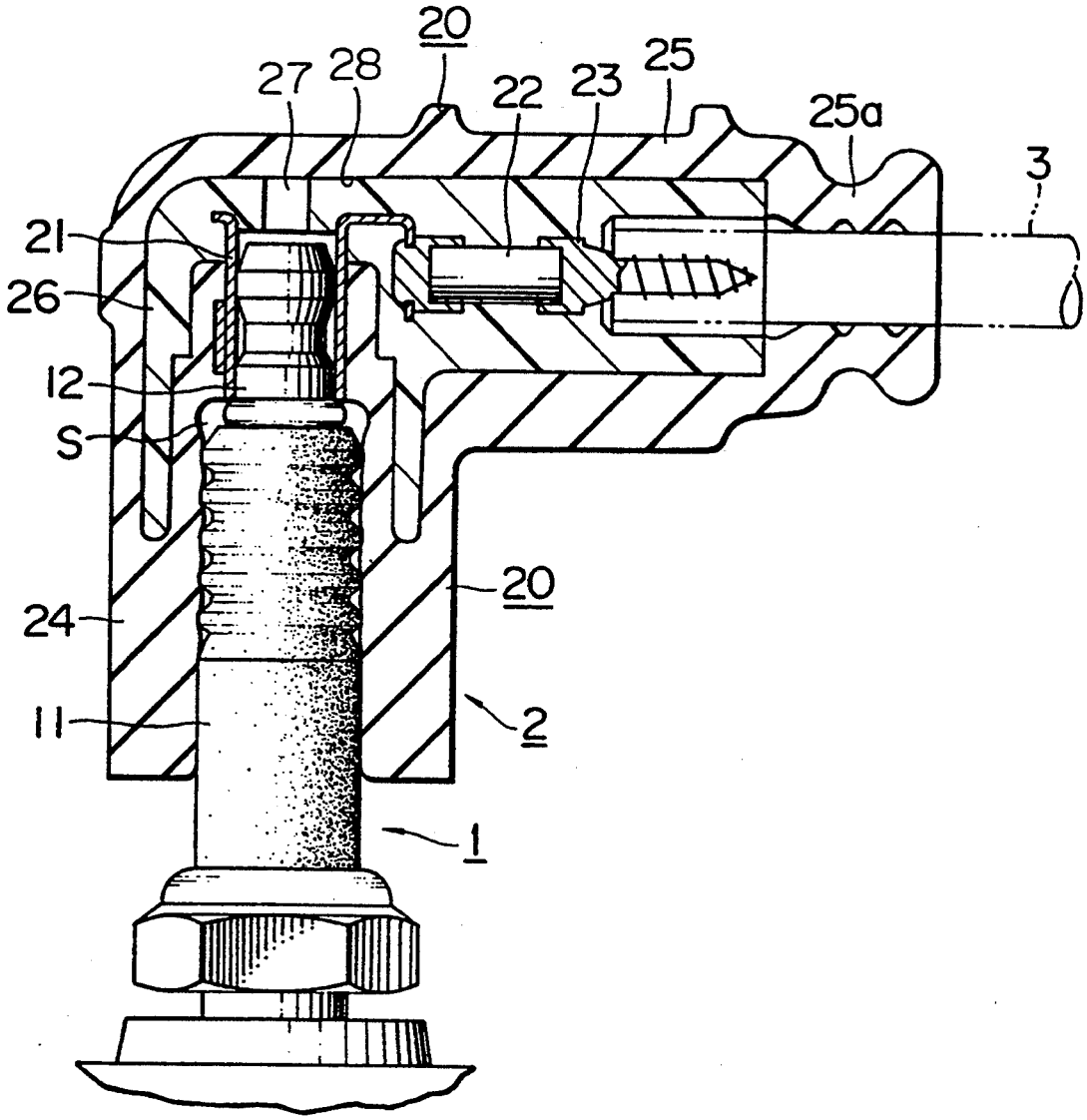
FIG. 1 is a vertical cross-sectional view of a spark plug cap provided in accordance with the present invention.

In FIG. 1, a spark plug cap 2 having a perpendicularly-bent, tubular rubber body 20 is attached to an insulating portion 11 of a spark plug 1. A metal connection member 21 for contact with a plug terminal 12 of the spark plug 1 is mounted within the plug cap 2. The metal connection member 21 is connected to a high-voltage cord 3 (indicated in phantom) via a bar-like resistor 22 and a screw 23, thereby electrically connecting the spark plug 1 to the high-voltage cord 3.

The rubber body 20 includes a cap body 24, and a terminal body 25 formed integrally with the cap body 24. The cap body 24 is attached to the insulating portion 11 of the spark plug 1 to seal the outer periphery of the insulating portion 11. An end portion of the high-voltage cord 3 is attached to a distal end portion 25*a* of the terminal body 25, so that the outer periphery of the end portion of the high-voltage cord 3 is sealed by the distal end portion 25*a*. The outer peripheries of the insulating portion 11 and the high-voltage cord 3 are thus sealed, thereby preventing fresh water or seawater from intruding along the outer peripheral surfaces of the insulating portion 11 and the high-voltage cord 3.

A core member 26 made of a plastic material having electrically-insulating properties such as a phenolic resin, is mounted within the rubber body 20. The core member 26 surrounds the metal connection member 21 and the bar-like resistor 22. The core member 26 extends downwardly beyond the plug terminal 12 into the peripheral wall of the cap body 24, thereby increasing the rigidity of the cap body 24. With this construction, the plug cap 2 can be firmly connected to the spark plug 1, so that the shaking of the plug cap 2 due to vibrations can be prevented, and therefore the plug terminal 12, the metal connection member 21 and the high-voltage cord 3 are enhanced in durability.

A through hole 27 is formed in that portion of the core member 26 disposed above the plug terminal 12. The through hole 27 defines a first volume communicating with a second volume S between the spark plug 1 and the cap body 24, with a surface 28 of contact between the core member 26 and the rubber body 20. The rubber body 20 and the core member 26 are gently held against each other at the contact surface 28, and are not fixed to each other.

The operation of the plug cap 2 will now be described.

The pressure of the air within the plug cap 2 increases when attaching the plug cap 2 to the spark plug 1, and the air intrudes via the through hole 27 to the contact surface 28 of the rubber body 20 held in contact with the core member 26, so that the air pressure acts on the contact surface 28. As a result, the terminal body 25 is slightly increased in diameter. Thus, the air moves to a space of a large capacity, and therefore the air pressure will not be increased so much. As a result, even if the rigidity of the cap body 24 is increased, the plug cap 2 is prevented from being lifted or displaced relative to the spark plug 1. Thereafter, the air, intruding into the area of contact between the core member 26 and the rubber body 20, passes between wires (not shown) of the high-voltage cord 3, and further passes between the distal end portion 25*a* of the terminal body 25 and the high-voltage cord 3 to escape to the exterior of the plug cap 2. Therefore, there is no risk that the plug cap 2 will be lifted or displaced out of position during the operation of the engine.

Fresh water or seawater has larger molecules than air, and is not under pressure, and, therefore water will not intrude into the plug cap 2 from the contact surface 28.

In the above embodiment, although the core member 26 is made of a plastic material, it may be made of any other suitable material so long as it has electrically-insulating properties. The through hole 27 of a circular transverse cross-section may be replaced, for example, by a slit-like or a groove-like through hole. Namely, the through hole 27 may be replaced by any other suitable communication means in so far as it can lead the air within the space S to the contact surface 28.

In the above embodiment, the core member 26 is extended into that portion of the peripheral wall of the cap body 24 surrounding the insulating portion 11, thereby firmly fixing the cap body 24 of the rubber body 20 to the insulating portion 11. However, the present invention is not limited to this arrangement in which the core member 26 is extended downwardly beyond the plug terminal 12. For example, the rubber of the cap body 24 may be greater in hardness than the rubber of the terminal body 25 so that the rubber body 20 can be firmly fixed to the insulating portion 11.

Although the plug cap 2 of the present invention is best suited for use in a boat or a motorcycle which is subjected to severe vibrations and is exposed to fresh water or seawater, this plug is not limited to such applications, and can be suitably used in an automobile and the like.

In the case where it is necessary to provide a larger air relief (escape) space, small ribs or wrinkles can be formed on the outer peripheral surface of the core member 26 without changing the appearance of the plug cap.

Figure 2A:
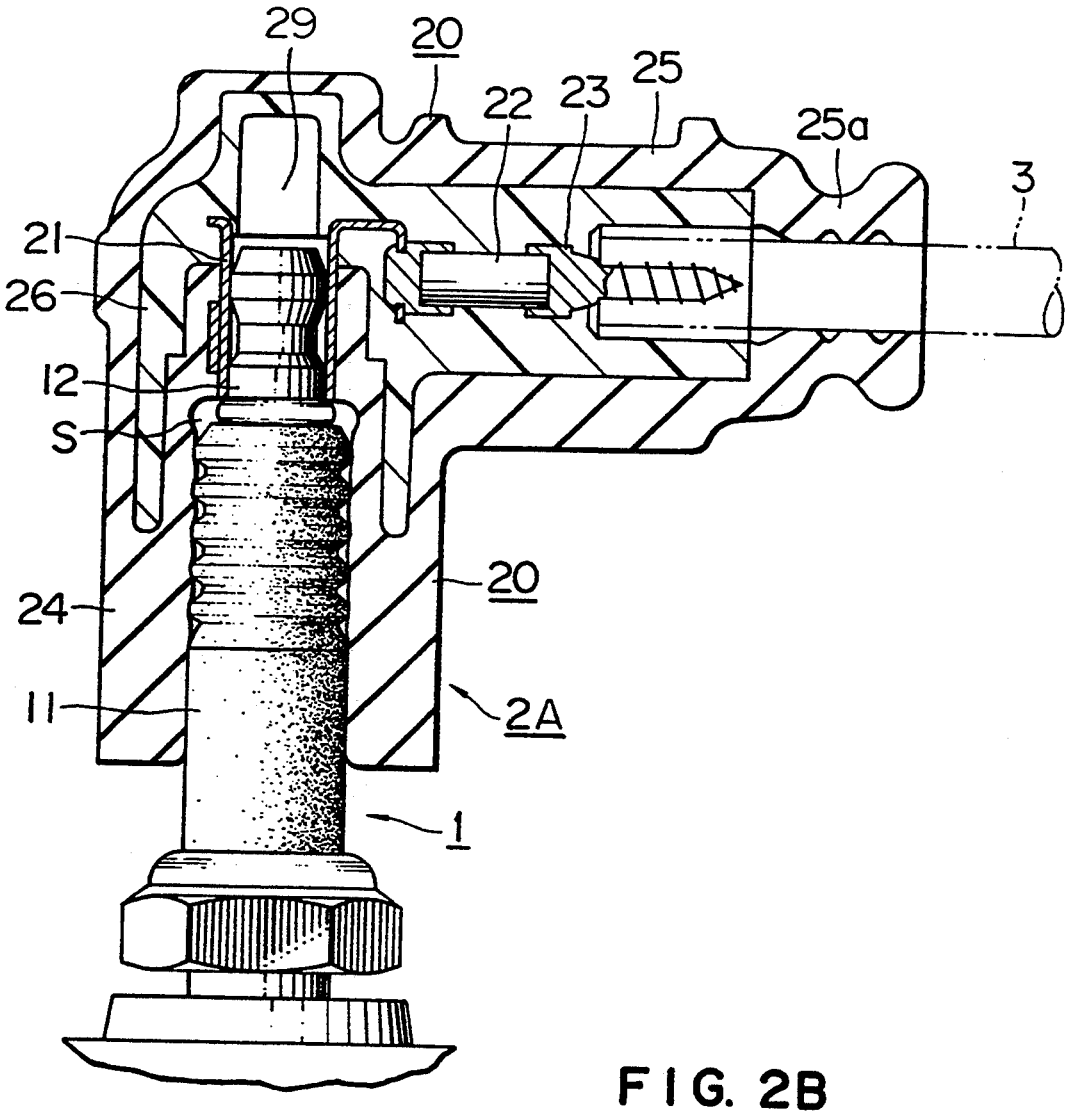
FIG. 2A is a view similar to 1 FIG. 1, but showing a modified spark plug cap of the invention.

FIG. 2A shows a modified spark plug cap 2A which differs from the plug cap 2 of FIG. 1 in that an air relief hole 29 in the form of a recess is provided instead of the through hole 27. The air relief hole 29 is formed in that portion of an inner surface of a core member 26 disposed in opposed relation to a distal end of a plug terminal 12. A part of the core member 26 and the terminal body 25 located above the plug terminal 12 is extended or projected upwardly to enable the formation of an air relief hole 29 of large height or volume. In this construction, the volume of a space S is increased by an amount corresponding to the volume of the air relief hole 29, and restrains a pressure increase.

Figure 2B:
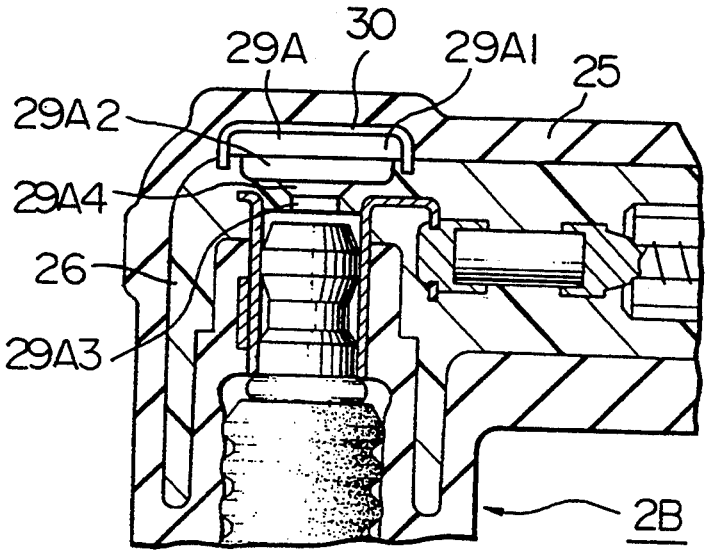
FIG. 2B is a view similar to FIG. 1, but showing a further modification of a spark plug cap according to the invention.
Figure 3:
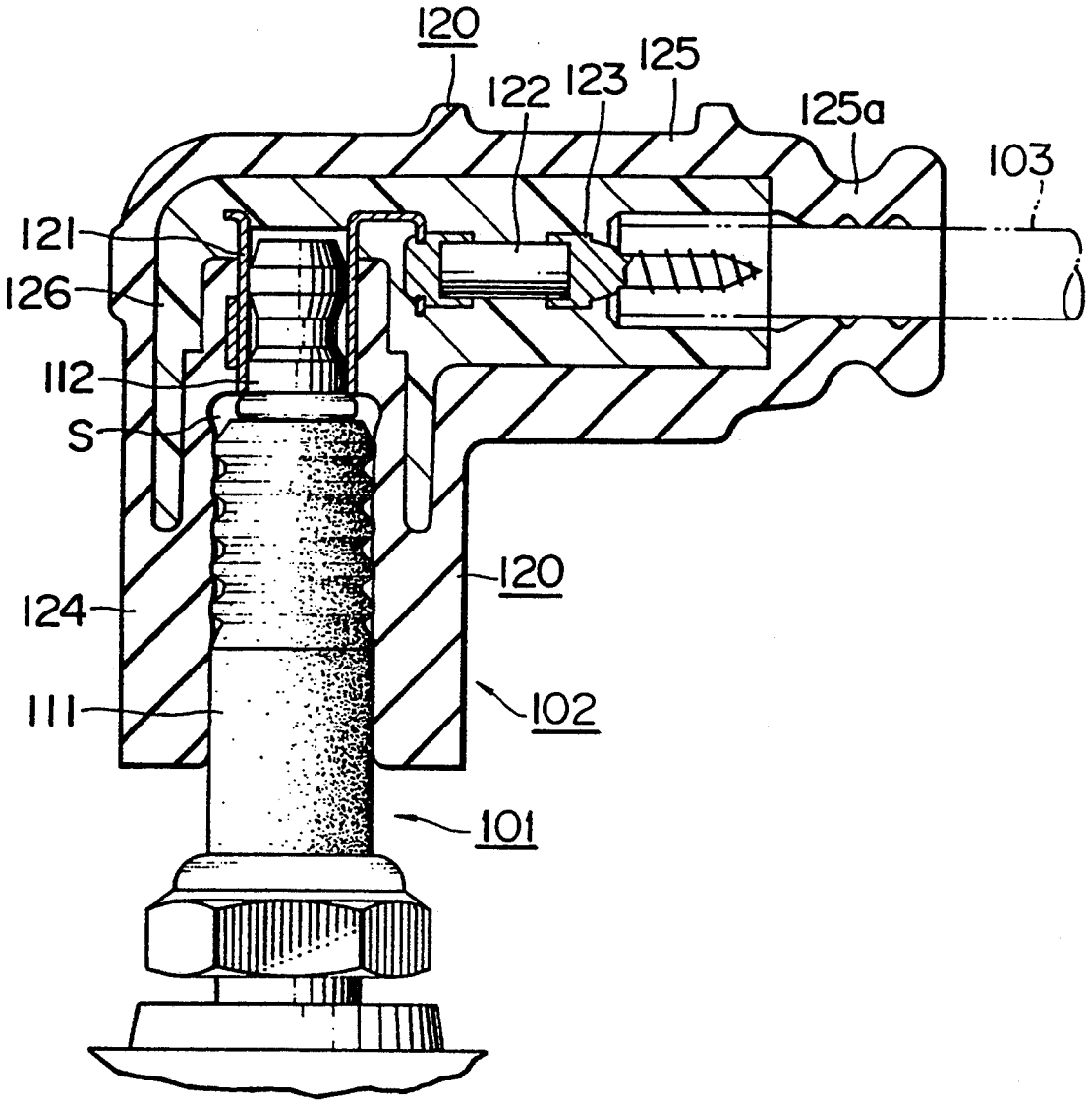
FIG. 3 PRIOR ART
FIG. 3 is a view similar to FIG. 1, but showing a conventional plug cap.

FIG. 2B shows a further modification of a spark plug cap 2B according to the invention which differs from the plug cap of FIG. 2A in that an air relief hole or a recess 29A having a small height and a large width, as compared with the relief hole 29 of FIG. 2, is provided. More specifically, the air relief hole 29A is a stepped recess having a top wide area 29A1 located in the terminal body 25, a lower narrow area 29A3 and intermediate areas 29A2 and 29A4. The areas 29A2, 29A4 and 29A3 are located in the core member 26 and extend therethrough. A support cap 30 is provided in the terminal body 25 and defines a top end surface of the recess 29A. In this construction, the volume of the relief hole or recess 29A is increased without increasing the height of the plug cap 2B. The support cap 30 serves to support the material of the terminal body 25 and helps to form the relief hole 29A. In other words, with the provision of the cap 30, the top wide area 29A1 of the relief hole 29A may be maintained in a desired shape having a large width and a small height.

As described above, in the embodiment shown in FIG. 1, when the pressure within the plug cap increases, the pressure acts on the contact surface of the rubber body via the through hole formed through the core member, so that the air escapes to the above contact surface, and further to the exterior of the plug cap. Therefore, even if the rigidity of the plug cap is increased so that the plug cap can be firmly fixed to the spark plug, there is no risk that the plug cap will be lifted or displaced relative to the spark plug.

Similar effects of preventing the plug cap from being lifted are obtainable also with the structures illustrated in FIGS. 2A and 2B.

What is claimed is:

1. A spark plug cap comprising:

a metal connection member for electrically connecting a spark plug to a high-volume cord;

a tubular rubber body for mounting on an end of the high-voltage cord and an insulating portion of the spark plug to seal said end and said insulating portion;

a core member within said rubber body surrounding said metal connection member;

a recess extending from an inner surface of said core member, through said core member, and into said tubular rubber body in combination with a space formed between the spark plug and said rubber body; and a support cap secured to said tubular rubber body therein and defining an end surface of said recess.

2. A spark plug cap according to claim 1 in which said rubber body includes a cap body for fitting on the insulating portion of the spark plug, said core member extending into a portion of said cap body surrounding the insulating portion.

3. A spark plug cap according to claim 1 in which said core member is an electrically-insulating material.

4. A spark plug cap according to claim 1 in which said core member is plastic.

5. A spark plug cap according to claim 1 in which said rubber body comprises a cap body for fitting on the insulating portion of the spark plug and a terminal body extending generally perpendicularly from one end of said cap body, said terminal body being fittable on the end portion of the high-voltage cord and said cap body being harder than said terminal body.

6. A spark plug cap according to claim 1 in which ribs are formed on an outer peripheral surface of said core member with which an inner surface of said rubber body is in contact.

* * * * *

UNITED STATES PATENT AND TRADEMARK OFFICE

CERTIFICATE OF CORRECTION

PATENT NO. : 5,358,415

DATED : OCTOBER 25, 1994

INVENTOR(S) : NITTA ET AL.

It is certified that error appears in the above-indentified patent and that said Letters Patent is hereby corrected as shown below:

Column 5, line 22, change "high-volume" to --high-voltage--;

Column 6, line 3, change "combination" to --communication--.

Signed and Sealed this

Fourteenth Day of February, 1995

*Attest:*

Bruce Lehman

BRUCE LEHMAN

*Attesting Officer*

*Commissioner of Patents and Trademarks*